US006971932B2

(12) United States Patent
Maselter

(10) Patent No.: US 6,971,932 B2
(45) Date of Patent: Dec. 6, 2005

(54) MARINE INBOARD/OUTBOARD SYSTEM

(76) Inventor: John F. Maselter, 31 Montecillo Dr., Rolling Hills Estates, CA (US) 90274

( * ) Notice: Subject to any disclaimer, the term of this patent is extended or adjusted under 35 U.S.C. 154(b) by 0 days.

(21) Appl. No.: 10/826,590

(22) Filed: Apr. 16, 2004

(65) Prior Publication Data

US 2005/0233655 A1 Oct. 20, 2005

(51) Int. Cl.[7] ..... B63H 23/34; B63H 20/14
(52) U.S. Cl. ..... 440/83; 440/75
(58) Field of Search ..... 440/57, 75, 83, 440/111, 112

(56) References Cited

U.S. PATENT DOCUMENTS 2,905,133 A * 9/1959 Clerk ..... 440/64
3,136,281 A * 6/1964 Kiekhaefer et al. ..... 440/52
3,256,851 A * 6/1966 Ackerman ..... 440/55
4,713,029 A * 12/1987 Ford ..... 440/89 R
4,925,413 A * 5/1990 Newman et al. ..... 440/75
5,340,345 A * 8/1994 Brodbeck et al. ..... 440/75
5,647,780 A * 7/1997 Hosoi ..... 440/53
6,299,496 B1 * 10/2001 Griffiths et al. ..... 440/89 R
6,406,344 B1 * 6/2002 Bland et al. ..... 440/88 R

* cited by examiner

*Primary Examiner*—Andrew D. Wright
(74) *Attorney, Agent, or Firm*—Christie, Parker & Hale, LLP

(57) ABSTRACT

A marine vessel is provided having a stern drive attached to the transom of the vessel. An actuator is provided for adjusting the pitch of the stern drive relative to the transom of the vessel. The stern drive is mounted on the transom of the vessel such that a driveshaft driven by the engine of the vessel and passing through the transom to enter the stern drive does so above the waterline of the vessel. Furthermore, the actuator is of a sufficient length to allow the pitch of the stern drive to be adjusted to such a degree that the entire stern drive can be brought above the waterline of the vessel. To this end, the actuator may be disposed between the transom of the vessel and a cantilevered member attached to the stern drive.

14 Claims, 6 Drawing Sheets

MARINE INBOARD/OUTBOARD SYSTEM

FIELD OF THE INVENTION

The present invention relates generally to marine inboard/outboard systems. More particularly, this invention relates to a system featuring a stern drive that is partially out of the water when in use and/or can be easily and completely lifted out of the water when not in use without the need to remove the stern drive from the vessel or the vessel from the water.

BACKGROUND OF THE INVENTION

Internal combustion marine drive systems come in several basic types, distinguished by the placement and articulation of the engine and drivetrain components. Differing choices in the layout of these components yield varying results in reliability, performance and ease of maintenance of the systems as a whole.

With an inboard system, a system featured mainly on larger vessels, the engine and almost all of the drivetrain components are placed inside the hull of the vessel towards the bottom, at or below the waterline. The engine and transmission are situated roughly equidistant from the bow, stern, port and starboard sides of the vessel. A propeller shaft extends rearwards from the transmission and tilts slightly downward, exiting the hull behind the inboard engine, ending underneath the bottom and towards the stern of the vessel. The engine of an inboard system can be a marinized automobile type four stroke engine or a purpose-built marine diesel and will typically have its own compartment within the hull. While an inboard engine takes up a good deal of room inside the hull that could otherwise be devoted to interior cabin space, it provides the vessel with excellent balance and a low center of gravity. In addition, the drivetrain used is generally considered the simplest and most efficient method of transferring torque from the engine to the propeller. However, because of the fixed position of the propeller shaft and reliance on a separate stern mounted rudder system, the inboard system is not as maneuverable at low speeds or while in reverse as are other systems.

In contrast an outboard system allows a user to steer by rotating the propeller shaft itself through a large arc. This is made possible by providing the engine, drivetrain and propeller all encased within a single unit externally mounted on the transom of the vessel. Because steering is achieved by rotating this unit as a whole to change the direction of thrust of the propeller, excellent low speed maneuverability is achieved. While the top portion of an outboard system contains the engine components and remains above the waterline, the bottom portion containing the drivetrain and propeller shaft extends beneath the waterline.

The placement of an outboard system on the transom of a vessel tends to make the vessel as a whole heavier at the stern. To minimize the negative effect an outboard system has on the weight balance of a vessel, these systems are designed to be lighter and more compact than an inboard system of comparable power. An outboard system of moderate size can readily be manually removed and replaced on a vessel by a single user. Outboard systems are an attractive option because of their low cost and simplicity.

As a compromise between the inboard system and the outboard system, an inboard/outboard ("I/O") system combines elements of both aforementioned systems to maximize the utility of each. In an I/O system, as with a true inboard system, the engine is placed inside the hull at or below the waterline and equidistant from the port and starboard sides of the vessel. However the I/O system differs in its placement of the engine towards the stern of the vessel near the transom. An engine driveshaft extends from the engine and exits the vessel through the transom below the waterline. The portion of an I/O system mounted externally on the transom is customarily known as the stern drive, or outdrive, and essentially resembles the lower portion of an outboard system. The stern drive receives the engine driveshaft exiting the vessel through the transom below the waterline and is attached to the transom of the vessel with six large bolts and nuts.

The interior of the stern drive contains a universal joint which enables the rotating shafts housed within the stern drive to turn in a horizontal plane and tilt in a vertical plane while transferring torque from the engine to the propeller shaft. The universal joint is necessary because the stern drive itself must be able to turn and tilt as a unit in order to steer the vessel and to trim the attitude of the vessel, respectively. As is known to those skilled in the art, the stern drive incorporates a gimble unit or other means which allow the lower portion of the unit to be adjusted in the manner described above. See, for example Bland et al U.S. Pat. No. 6,296,535, incorporated herein by reference.

Also provided are a series of gears that allow the rotating shafts inside the stern drive to connect with one another through a series of ninety degree turns. Specifically, these gears allow the engine driveshaft to connect with a vertical shaft, and further allow this vertical shaft to connect with a horizontal propeller shaft. A housing, bellows, and/or other means protect the mechanical components of the stern drive such as the aforementioned gears and universal joint from the corrosive effects of the salt water environment of the stern drive.

The advantages of an I/O system are that a large, fuel efficient automotive type four stroke or marinized diesel engine can be used as with a true inboard. The weight balance of the vessel, while not as good as with a true inboard given the aft placement of the engine, is still better than an outboard system where the weight of the engine rests entirely outside the hull of the vessel. The steering and trimming functionalities of an outboard system are preserved, as is a good deal of interior cabin space in the vessel given the sternward placement of the engine.

Despite their advantages, prior art I/O systems suffer from the notable drawback of susceptibility to failure caused by salt water damage. Because the stern drives in prior art I/O systems are permanently placed below the waterline, their interior mechanical components are vulnerable to damage caused by seawater entering the stern drive. Although bellows are provided to protect the interior mechanical components of the stern drive from the salt water environment in which the stern drive is located, leaks in said bellows do occur necessitating costly repairs for the user. Even if a leak in said bellows does not occur, it is still necessary to replace said bellows on a regular basis, which is also costly for the user.

In addition, routine maintenance tasks such as oil changes and the like can only be performed on the stern drive with the vessel itself removed from the water. Cleaning the exterior housing of the stern drive to remove algae and barnacles can only be performed with the vessel removed from the water or by a trained diver. There exists a need for a stern drive which eliminates the problems stated above, while retaining the natural advantages of the design.

It is understood that the present invention relates to a wide range of prior art I/O systems including embodiments not explicitly discussed above. For example, in an alternative embodiment of the prior art I/O system, the stern drive additionally comprises two propellers as well as mechanical means to turn two propellers in opposite directions. Otherwise, this alternative embodiment of the prior art is substantially the same as the system described above. The improved marine inboard/outboard system of the present invention is an improvement over both these embodiments of the prior art.

SUMMARY OF THE INVENTION

In an embodiment of the present I/O system a stern drive is provided comprising a vertical shaft driven by an upper driveshaft, a propeller shaft driven by the vertical shaft, and a housing attached to a transom of a vessel and enclosing the vertical shaft. An engine is provided to drive an upper driveshaft. The upper driveshaft passes through the transom of the vessel and enters the stern drive above a predetermined waterline. Because the top portion of the stern drive is out of the water, the interior mechanical components of the stern drive such as the universal joint are at much less risk of damage from the salt water environment. A bellows may be used enclosing these components as in the prior art to further reduce this risk.

In another embodiment of the present invention a marine vessel is provided comprising a hull which includes a transom, a predetermined waterline intersecting the hull and the transom, an engine disposed within the hull, an upper driveshaft driven by the engine, and a stern drive attached to the transom. The stern drive includes a vertical shaft driven by an upper driveshaft, a propeller shaft driven by the vertical shaft, and a housing attached to the transom and enclosing the vertical shaft. The propeller shaft exits the housing of the stern drive and the upper driveshaft passes through the transom and enters the stern drive above the predetermined waterline.

In a further embodiment of the present I/O system, a mounting plate attached to the transom of a vessel. An actuator is disposed between the housing of the stern drive and the transom of the vessel. Prior art actuators are customarily disposed between the mounting plate and the housing of the stern drive. However, the placement in the present invention allows a much longer actuator to be used. Additionally, a cantilevered member may be provided attached to the housing of the stern drive, and the actuator may be disposed between the cantilevered member and the transom of the vessel.

The actuator is comprised of a piston and cylinder, and is attached to the transom and cantilever using a pair of actuator hinges. The actuator hinges allow the actuator to change its pitch as it extends and contracts to adjust the position of the housing of the stern drive by tilting it about a pivot. The actuator of the present invention can reposition the stern drive between an operative position below the predetermined waterline and a maintenance position wherein the stern drive is lifted partially or even completely above the predetermined waterline.

In another embodiment, the vertical shaft of the stern drive is driven by the upper driveshaft through a first set of gears and a universal joint located above the predetermined waterline. Similarly, the vertical shaft drives the propeller shaft though a second set of gears. The engine drives the upper driveshaft through an engine driveshaft extending from the engine, a flywheel connected to the engine driveshaft, and a drive wheel connected to the upper driveshaft and engaging said flywheel. The housing of the stern drive may be made to completely enclose the second set of gears in a watertight manner.

In a further embodiment, the engine drives the upper driveshaft through an engine driveshaft extending from the engine, a lower pulley connected to the engine driveshaft, an upper pulley connected to the upper driveshaft, and one or more belts connecting the lower pulley to the upper pulley. The engine may also drive the upper driveshaft through an engine driveshaft extending from the engine, wherein the engine is disposed within the hull so that the engine driveshaft lies coaxial with the upper driveshaft, and wherein the engine driveshaft rotatably engages the upper driveshaft.

In yet another embodiment, the engine drives the upper driveshaft through an engine driveshaft extending from the engine, a lower gear set connected to the engine driveshaft, an interior upright shaft connected to the lower gear set, and an upper gear set connecting the interior upright shaft to the upper driveshaft. The gear sets are constructed to transfer torque from one rotating shaft to another shaft substantially perpendicular to the first, and may incorporate one or more beveled gears.

In conjunction with these improvements, an improved I/O system is provided having a cooling system connected to the engine, a water pump connected to the cooling system, a water intake connected to the water pump, and wherein the water intake is located outside the housing of the stern drive.

The improved I/O system may further comprise an exhaust system running from the engine to a terminal point above the predetermined waterline. The exhaust system may include a muffler.

Figure 1:
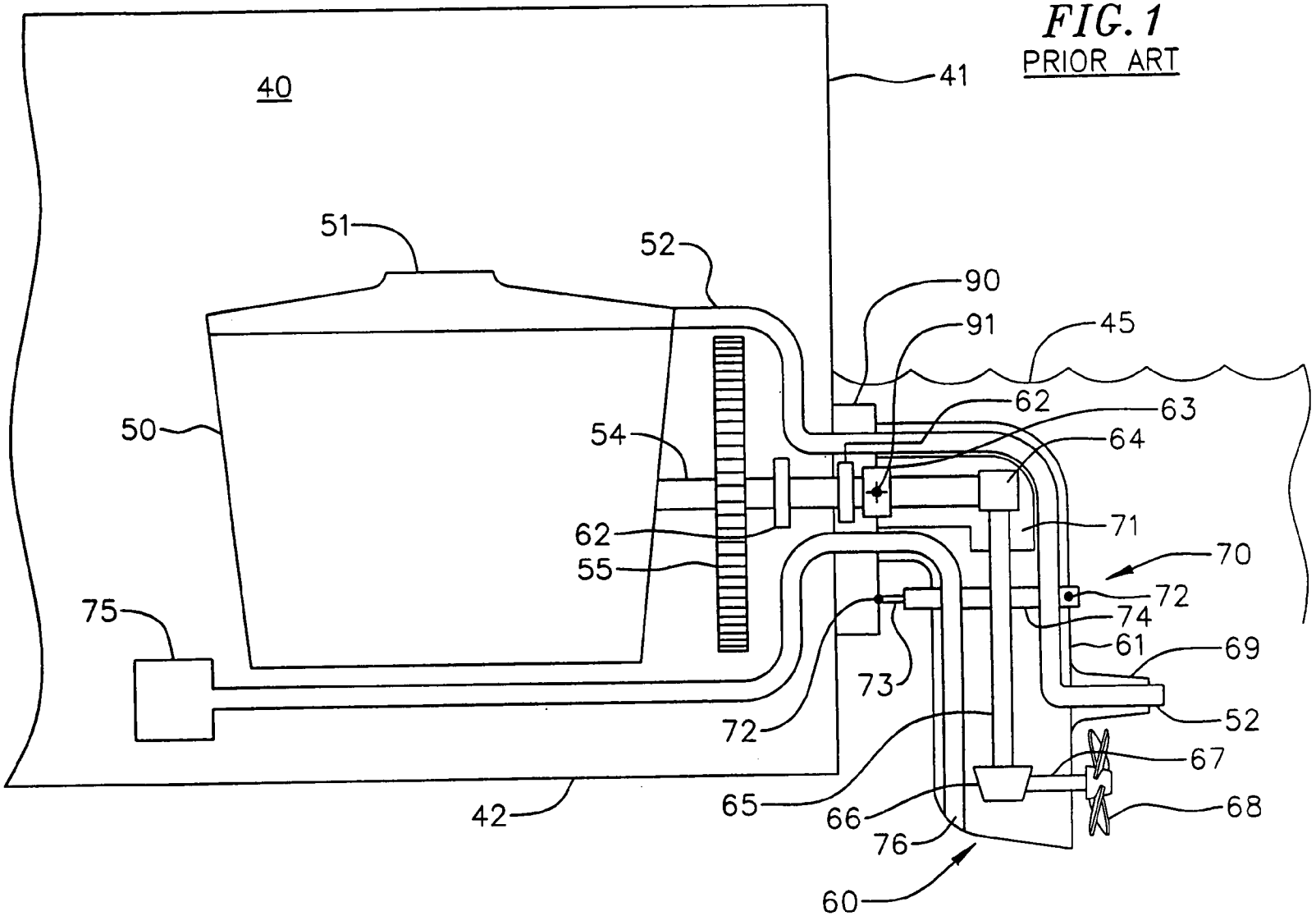
FIG. 1 PRIOR ART
FIG. 1 is a side view of a prior art stern drive having a conventional placement and articulation.

Before any embodiment of the invention is explained in detail it is to be understood that the invention is not limited in its application to the exemplary details of construction and arrangements of components set forth in the following description or illustrated in the drawings. For example, although the actuator will be described in the context of a hydraulic cylinder, it will be appreciated that in lieu of using a hydraulic actuator, an electromechanical actuator could be employed to impart the thrust required to trim the stern drive propulsion system. Thus, the invention is capable of other embodiments and of being practiced or being carried out in various ways. Also, it is to be understood that the terminology used herein is for the purpose of illustrative description and should not be regarded as limiting.

DETAILED DESCRIPTION OF THE INVENTION

Referring now to the drawings, and more particularly to FIG. 1, there is shown an illustration of a prior art design of an I/O system. A side view of the system is shown installed in a vessel 40 having a transom 41 and bottom hull 42. A stern drive 60 is shown comprising a stern drive mounting plate 90, a housing 61 attached to the stern drive mounting plate 90 and the components contained therein, described in detail below. The stern drive mounting plate 90 is attached to the transom 41 of the vessel 40 by six large bolts (not shown). As is known to those skilled in the art, the stern drive 60 can include a gimble unit (not shown) or other suitable means interposed between the stern drive mounting plate 90 and the housing 61 which allow the housing 61 to pivot in relation to the stern drive mounting plate 90 about a pivot 91. See gimble unit 30 of FIG. 3, in Bland et al U.S. Pat. No. 6,296,535.

An engine 50 is shown within the vessel 40 partially below the waterline 45. An engine driveshaft 54 extends from the engine 50 and connects to a flywheel 55. As is known to those skilled in the art, the flywheel 55 is used for the smooth operation of the engine 50 and can be engaged by a starter motor (not shown) when a user desires to start the engine 50.

The engine driveshaft 54 passes though the flywheel 55 and a gimble bearing 62 before passing through the transom 41 to enter the stern drive 60. For increased stability, multiple gimble bearings 62 may be used, and they may be disposed to support the upper driveshaft on either or both sides of the transom 41. The stern drive 60 is shown here completely submerged below the waterline 45. A bellows 71 is provided in the top portion of the stern drive 60 to protect the mechanical components therein, including a universal joint 63 and gears 64, from corrosion. The engine driveshaft 54 connects to the universal joint 63. The universal joint 63 connects through a shaft to the gears 64. The gears 64 connect to a vertical shaft 65 which runs downward through the housing 61 of the stern drive 60 to connect with gears 66. The gears 66 connect to a propeller shaft 67, which in turn is connected to a propeller 68.

An anti-cavitation plate 69 is part of the stern drive housing 61. An actuator 70 extends from the stern drive mounting plate 90 to engage the housing 61. The actuator is comprised of a cylinder 72 and piston 73. The actuator 70 is attached to the stern drive mounting plate 90 and the housing 61 using a pair of actuator hinges 72. The actuator hinges 72 allows the actuator 70 to change its pitch as it extends and contracts to adjust the lower portion of the stern drive 60.

The actuator 70 rotates the stern drive 60 about the universal joint 63 and gimble unit or other means known in the art, both of which allow rotation in relation to the pivot 91 of the components they connect. The universal joint pivot location may be different than the stern drive pivot 91, if desired. This actuator allows a user of the stern drive 60 to trim the attitude of the stern drive 60. This actuator also allows a user to raise the stern drive 60 so that the vessel can be held low on a trailer while ensuring ground clearance of the stern drive 60. However, the stern drive 60 cannot be lifted completely out of the water in the prior art I/O system shown in FIG. 1.

The I/O system shown in FIG. 1 also includes an exhaust conduit 52 connected to the manifold 51 of the engine 50. The exhaust conduit 52 is routed through the stern drive 60 and exits the housing 61 of the stern drive 60 through the anti-cavitation plate 69. A water pump 75 is connected to the water intake 76. The water intake 76 takes water into the stern drive 60 and passes it through the transom 41 to the interior of the vessel 40 in order to cool the engine 50.

Figure 2:
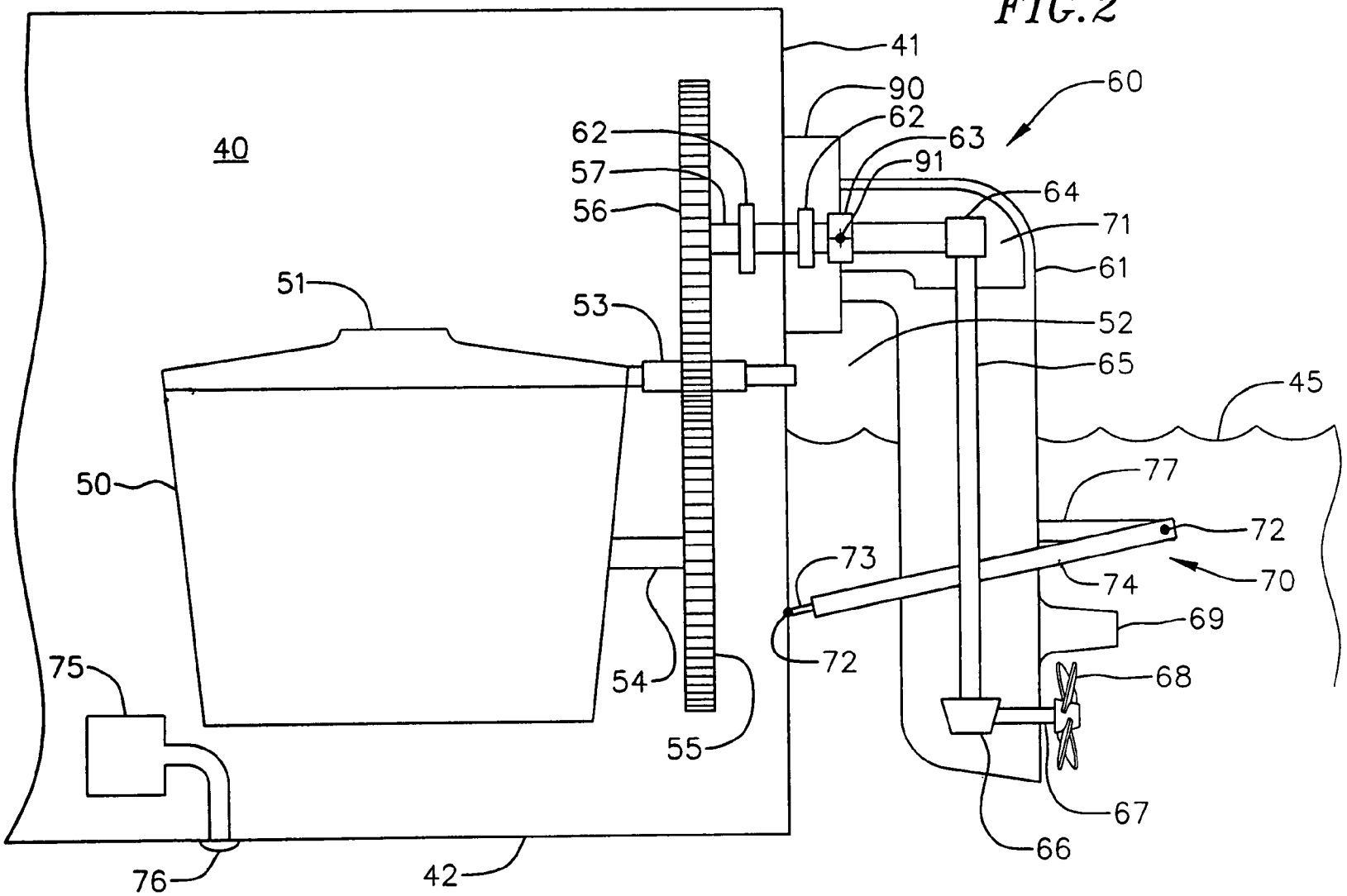
FIG. 2 is a side view of an improved stern drive configuration.

FIG. 2 shows one embodiment of the present improved marine I/O system. The stern drive 60 is shown comprising a stern drive mounting plate 90, a housing 61 and the components contained therein, described in detail below. The stern drive mounting plate 90 is attached to the transom 41 by six large nuts and bolts (not shown). As described above and known in the prior art, the stern drive 60 can include a gimble unit (not shown) or other suitable means interposed between the stern drive mounting plate 90 and the housing 61 which allow the housing 61 to pivot in relation to the stern drive mounting plate 90 about a pivot 91. An anti-cavitation plate 69 is provided as part of the housing 61.

An upper driveshaft 57 is positioned so that it exits the transom 41 of the vessel 40 above the waterline 45. The stern drive 60 is positioned on the transom 41 in turn so that the mechanical components in the top portion of the stern drive, including the universal joint 63 and gears 64, lie in the same horizontal plane as the upper driveshaft 57. This has the result that the universal joint 63 and the gears 64 will also lie above the waterline 45. Because of this, the universal joint 63 and the gears 64 are at much less risk of damage from the salt water environment. A bellows 71 may be used enclosing these components as in the prior art to further reduce this risk.

The upper driveshaft 57 passes though a gimble bearing 62 before passing through the transom 41 to enter the interior of the stern drive 60. For increased stability, multiple gimble bearings 62 may be used, and they may be disposed to support the upper driveshaft on either or both sides of the transom 41. The upper driveshaft 57 enters the interior of the stern drive 60 and engages the universal joint 63, which in turn engages the gears 64. The gears 64 connect to a vertical shaft 65 which runs downward through the housing 61 of the stern drive 60, crossing the level of the waterline 45 to connect with gears 66. The propeller shaft 67 is connected to the gears 66, and is in turn connected to the propeller 68.

The actuator 70 rotates the lower portion of the stern drive 60 about the pivot 91. The actuator 70 is comprised of a piston 73 and a cylinder 74. In the present stern drive 60, the actuator 70 extends from the transom 41 to a cantilever 77 provided attached to the housing 61. The actuator 70 is attached to the transom 41 and the cantilever 77 using a pair of actuator hinges 72. The actuator hinges 72 allow the actuator 70 to change its pitch as it extends and contracts to adjust the position of the stern drive 60.

By attaching one end of the actuator 70 to the transom 41 directly or through an actuator mounting plate (not shown) rather than to the stern drive mounting plate 90 as in the prior art, and by attaching the other end of the actuator 70 to a cantilever 77, a much longer actuator 70 can be used than in the prior art. The elongated actuator 70 of the present invention can effectively reposition the stern drive 60 between an operative position below the waterline 45 and a maintenance position wherein the stern drive 60 is lifted partially or even completely above the waterline 45. Because the stern drive 60 is mounted on the transom 41 such that the top portion of stern drive 60 lies above the waterline 45, this rotation can result in the entire stern drive 60 being above the waterline 45 when the actuator 70 is fully extended.

The I/O system shown in FIG. 2 differs from the prior art in the additional respect that the exhaust conduit 52 and the water intake 76 of the engine 50 are both routed directly through the hull of the vessel 40 and do not pass through the stern drive 60. As shown in FIG. 2, the exhaust conduit 52 runs from the manifold 51 of the engine 50 through the transom 41 above the waterline 45. The exhaust conduit 52 incorporates a muffler 53. In addition, FIG. 2 shows a water pump 75 connected to a water intake 76 which is attached to the bottom hull 42 of the vessel 40. Because of these improvements, the lower portion of the housing 61 of the stern drive 60 can be constructed as a single, watertight unit and may employ aluminum or another suitable material.

FIG. 2 shows the present stern drive 60 placed so that the portion of the stern drive 60 that attaches to the transom 41 is above the waterline. However, the engine 50 is placed at or below the waterline within the hull of the vessel 40, as is standard with I/O systems. Because the upper driveshaft 57 of the stern drive 60 is not on the same level with the engine driveshaft 54, the problem arises of how to transfer power from the latter to the former. In FIG. 2 a flywheel 55 is shown attached to the engine driveshaft 54. The flywheel 55 has teeth on it which enable it to engage drive gear 56. Drive gear 56 is in turn attached to the upper driveshaft 57, which passes through the transom 41 to the interior of stern drive 60.

Various methods may be used to allow the upper driveshaft 57 of the stern drive 60 to exit the transom 41 above the waterline 45. In an alternative embodiment shown in FIG. 3, the engine driveshaft 54 extends from the engine 50 and connects to a flywheel 55. The flywheel 55 rotatably engages a lower pulley 80. The lower pulley 80 engages a belt 81 which turns an upper pulley 82. The upper pulley 82 is connected to the upper driveshaft 57. A plurality of belts may also be used to provide redundancy and ensure the smooth operation of the system in the event of a failure of any single belt.

Figure 4:
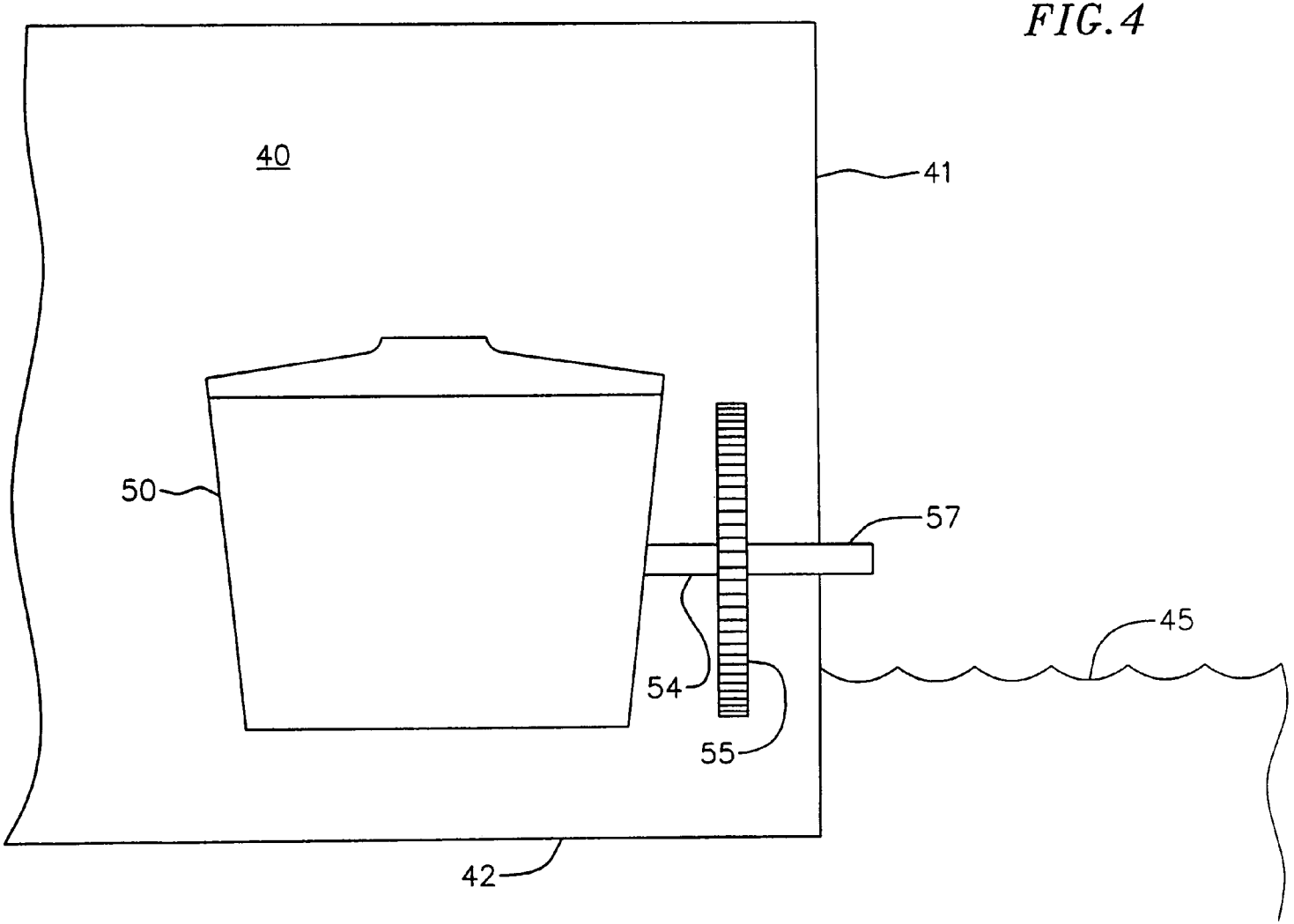
FIG. 4 is a side view of the improved stern drive of FIG. 1 wherein the engine is placed on the same level as the top portion of the stern drive for a simplified drivetrain.

Alternately, the engine 50 may be placed in a higher position within the vessel 40 to match the raised placement of the stern drive 60, as shown in FIG. 4. In this embodiment, the engine driveshaft 54 extends from the engine 50 and connects to a flywheel 55. The flywheel 55 connects to an upper driveshaft 57. In this manner the mechanical linkages between the engine 50 and the stern drive 60 can be the same simple components as shown in the prior art FIG. 1, while still allowing for a raised placement of the stern drive 60 on the transom 41.

Figure 3:
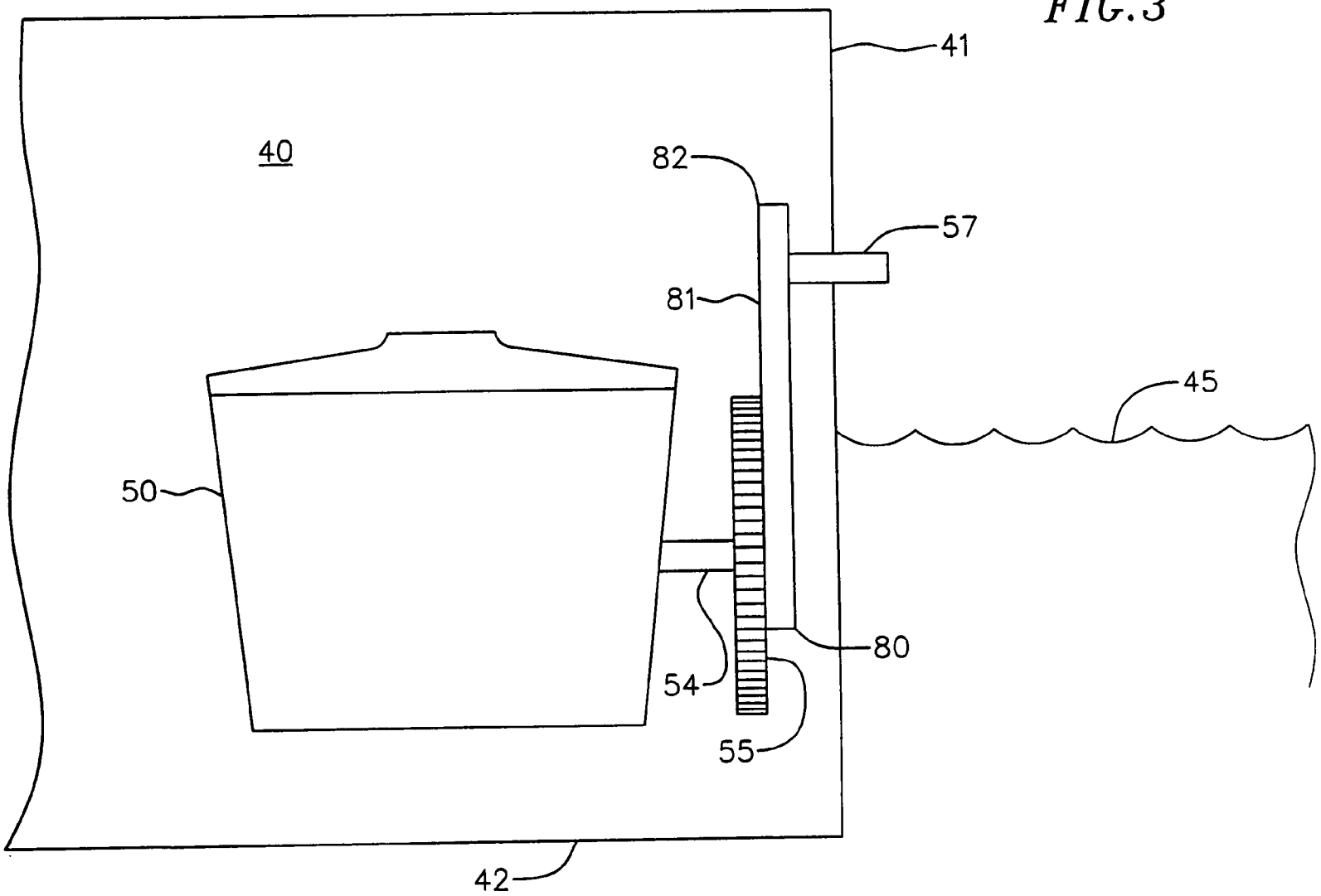
FIG. 3 is a side view of the improved stern drive of FIG. 1 using a belt and pulley system in the drivetrain.
Figure 5:
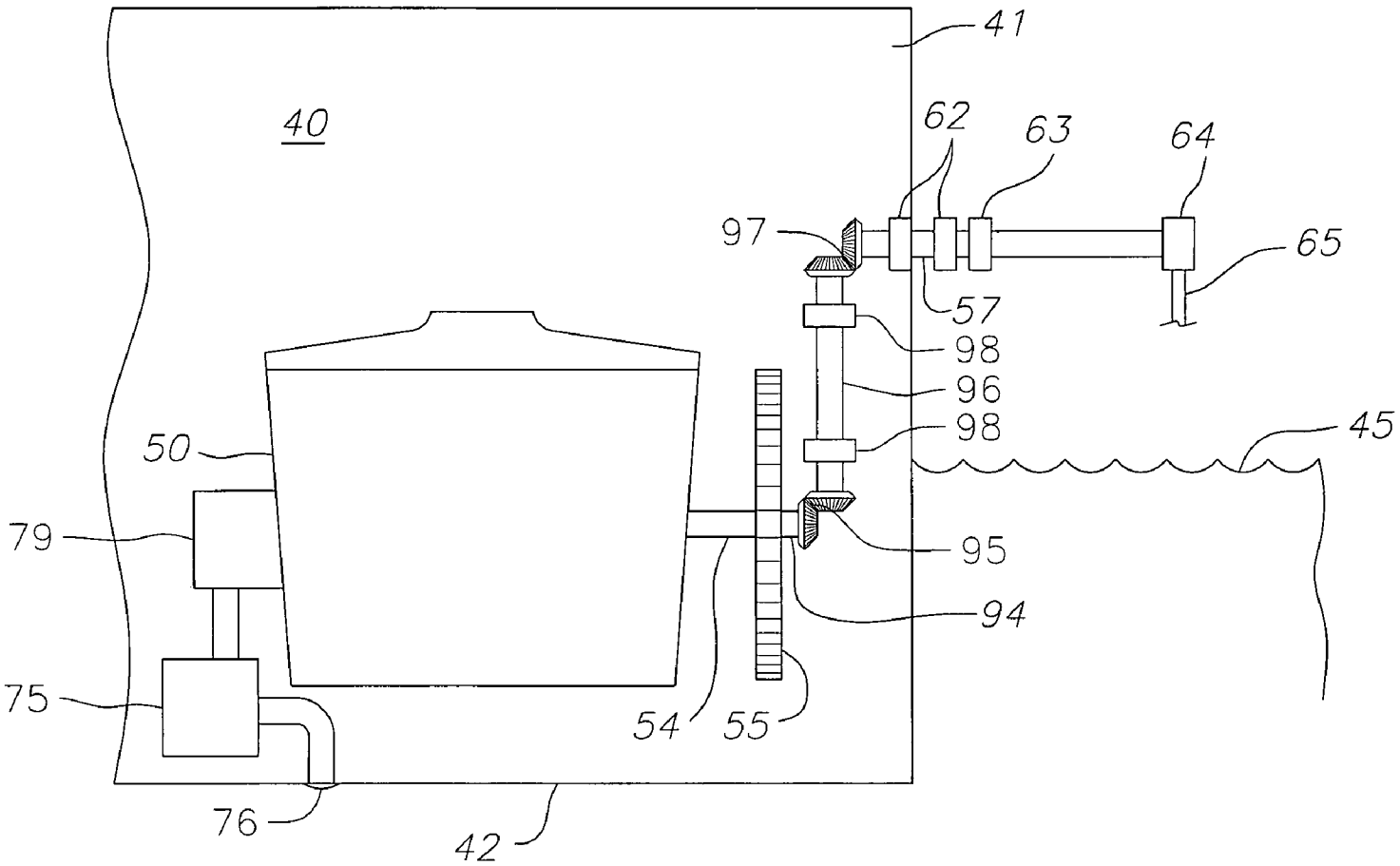
FIG. 5 is a side view of the improved stern drive wherein gear sets and a vertical shaft are disposed within the hull of the vessel and used to connect the engine driveshaft with the upper driveshaft.

In yet another alternative shown in FIG. 5, the engine 50 may be placed in a position within the vessel 40 similar to those shown in FIGS. 2 and 3. In the embodiment of FIG. 5, the engine driveshaft 54 extends from the engine 50 and connects to a flywheel 55. The flywheel 55 in turn connects to a linking shaft 94. The linking shaft 94 then engages a lower gear set 95. This gear set may comprise a pair of beveled gears or other appropriate mechanism to allow two shafts to be rotatably connected through a ninety degree angle. The lower gear set 95 engages an interior upright shaft 96, which in turn engages an upper gear set 97. The interior upright shaft 96 is held in position by two bearings 98. The upper gear set 97 is of a similar constitution to the lower gear set 95, and connects the interior upright shaft 96 with the driveshaft 57. From the point at which the driveshaft 57 passes through the transom 41 on, the stern drive may be implemented in a fashion similar to the embodiments discussed above. By providing the two separate gear sets for use with the interior upright shaft, yet another alternative is provided to allow the upper driveshaft 57 of the stern drive 60 to exit the transom 41 above the waterline 45. Advantages of providing the upright shaft 96 and the gear sets 95 and 97 to link the engine driveshaft 54 with the upper driveshaft 57 include a smooth transfer of torque by the gear sets 95 and 97 similar to the smooth transfer of torque by the gears 64 and 66.

FIG. 5 shows the water intake 76 routed directly through the hull of the vessel 40. A water pump 75 is connected to the water intake 76. The water pump 75 is in turn connected to a cooling system 79 connected to the engine 50.

As is known to one skilled in the art, gear sets may be used which incorporate a mechanism allowing the torque to be transferred between a pair of rotating shafts forming an acute or obtuse angle rather than a ninety degree angle. With such gear sets, the interior upright shaft 96 need not be entirely vertical and may be made to slant towards the front or rear of the vessel 40 to match a slope in the transom 41, or to accommodate some interior geometry of the vessel.

Figure 6:
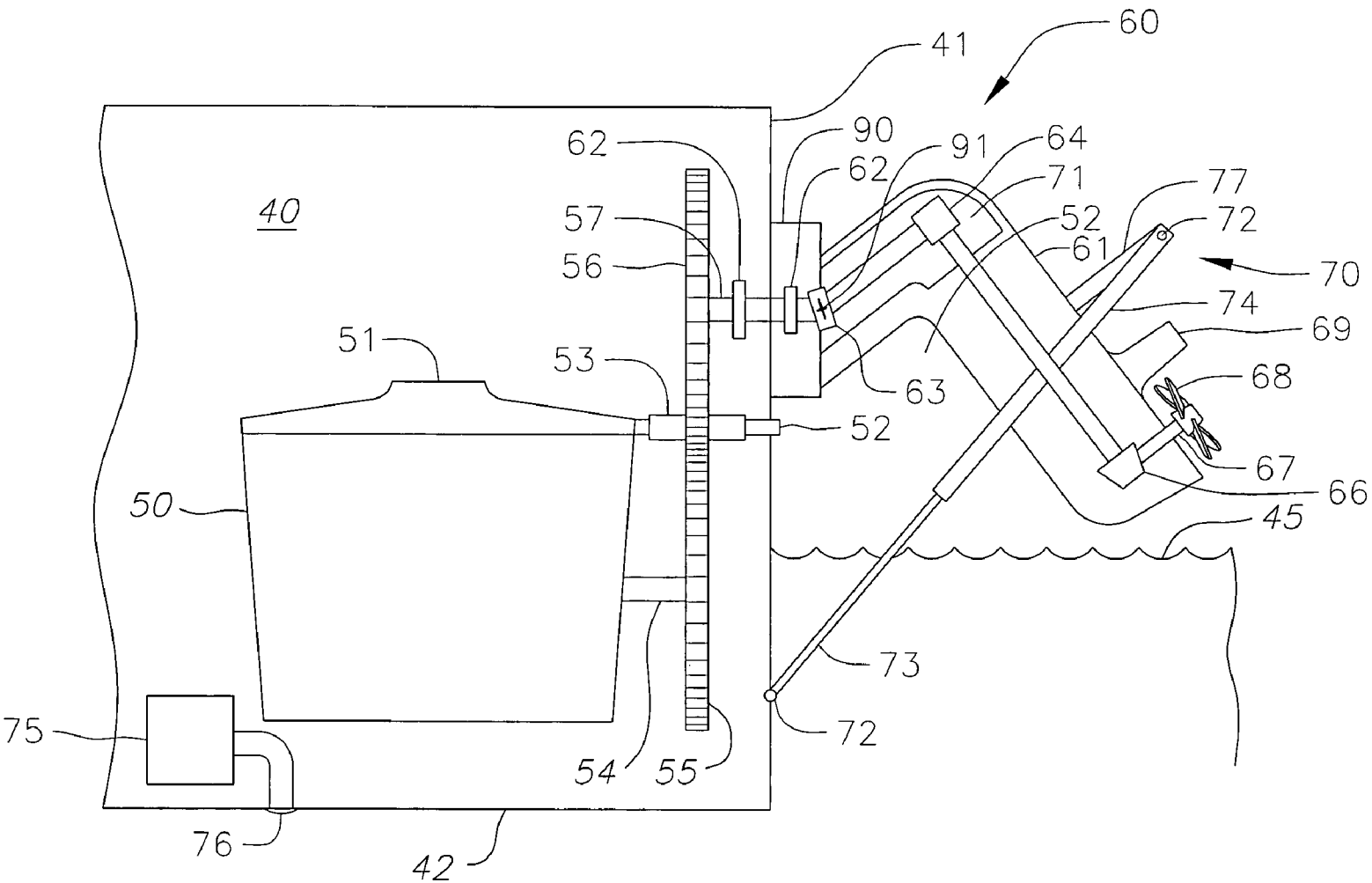
FIG. 6 is a side view of a further embodiment of an improved stern drive wherein the stern drive is in a substantially horizontal position.

FIG. 6 shows a side view of a further embodiment of an improved stern drive wherein the stern drive 60 is in a substantially horizontal position.

What is claimed is:

1. An improved marine vessel comprising:

a hull, the hull including a transom and having a predetermined waterline intersecting the hull and transom;

an engine disposed within the hull;

an engine driveshaft driven by the engine;

a lower gear set;

an interior upright shaft driven by the engine driveshaft through the lower gear set;

an upper gear set;

an upper driveshaft passing through the transom and driven by the interior upright shaft through the upper gear set; and a stern drive attached to the transom, the stern drive comprising:

a vertical shaft driven by the upper driveshaft;

a propeller shaft driven by the vertical shaft; and a housing attached to the transom and enclosing the vertical shaft;

wherein the propeller shaft exits the housing of the stern drive; and wherein the upper driveshaft passes through the transom and enters the stern drive above the predetermined waterline.

2. The vessel of claim 1, wherein the engine driveshaft and the interior upright shaft form an angle of approximately ninety degrees; and wherein the upper driveshaft and the interior upright shaft form an angle of approximately ninety degrees.

3. The vessel of claim 1, wherein the lower gear set includes at least one beveled gear; and wherein the upper gear set includes at least one beveled gear.

4. The vessel of claim 1, wherein the stern drive includes a mounting plate attached to the transom of the vessel above the predetermined waterline.

5. The vessel of claim 1, further comprising an actuator for trimming the attitude of the stern drive disposed between the housing of the stern drive and the transom of the vessel.

6. The vessel of claim 5, wherein the stern drive further comprises a cantilevered member attached to the housing; and wherein the actuator is disposed between the cantilevered member and the transom of the vessel.

7. The vessel of claim 5, wherein the actuator repositions the housing of the stern drive between an operative position below the predetermined waterline and a maintenance position wherein substantially all of the housing of the stern drive is lifted above the predetermined waterline.

8. The vessel of claim 5, wherein the actuator repositions the housing of the stern drive between a substantially vertical position and a substantially horizontal position.

9. The vessel of claim 8, wherein the propeller shaft of the stern drive is brought above the predetermined waterline when the stern drive is in a substantially horizontal position.

10. The vessel of claim 8, wherein the stern drive is brought completely above the predetermined waterline when in a substantially horizontal position.

11. The vessel of claim 1, wherein the vertical shaft is driven by the upper driveshaft through a first set of gears and a universal joint located above the predetermined waterline.

12. The vessel of claim 1, further comprising:

a cooling system connected to the engine;

a water pump connected to the cooling system; and a water intake connected to the water pump;

wherein the water intake is spaced apart from the stern drive.

13. The vessel of claim 1, further comprising an exhaust system running from the engine to a terminal point on the transom of the vessel above the predetermined waterline.

14. The vessel of claim 13, wherein the exhaust system includes a muffler.

* * * * *